US010871173B2

(12) United States Patent
Bertoneri

(10) Patent No.: US 10,871,173 B2
(45) Date of Patent: Dec. 22, 2020

(54) DRY GAS EXTRACTION DEVICE AND METHOD

(71) Applicant: NUovo Pignone Srl, Florence (IT)

(72) Inventor: Matteo Bertoneri, Florence (IT)

(73) Assignee: NUOVO PIGNONE SRL, Florence (IT)

( * ) Notice: Subject to any disclaimer, the term of this patent is extended or adjusted under 35 U.S.C. 154(b) by 358 days.

(21) Appl. No.: 15/312,669

(22) PCT Filed: May 22, 2015

(86) PCT No.: PCT/EP2015/061422

§ 371 (c)(1),
(2) Date: Nov. 21, 2016

(87) PCT Pub. No.: WO2015/181081

PCT Pub. Date: Dec. 3, 2015

(65) Prior Publication Data

US 2017/0184130 A1 Jun. 29, 2017

(30) Foreign Application Priority Data

May 26, 2014 (IT) ..... FI2014A0124

(51) Int. Cl.
*F04D 29/70* (2006.01)
*F04D 29/12* (2006.01)
(Continued)

(52) U.S. Cl.
CPC ..... *F04D 29/706* (2013.01); *F04D 17/122* (2013.01); *F04D 29/083* (2013.01);
(Continued)

(58) Field of Classification Search
CPC .. F04D 29/706; F04D 29/4206; F04D 29/286; F04D 29/083; F04D 17/122; F04D 29/104; F04D 29/124
See application file for complete search history.

(56) References Cited

U.S. PATENT DOCUMENTS 3,740,163 A * 6/1973 Schinnerer ..... F01D 25/22 415/111
4,913,631 A 4/1990 Vandendorpe
(Continued)

FOREIGN PATENT DOCUMENTS

EP 1577561 A1 9/2005
EP 2092972 A1 8/2009
(Continued)

OTHER PUBLICATIONS

Italian Search Report issued in connection with corresponding Italian application FI2014A000124 dated Jan. 21, 2015.
(Continued)

*Primary Examiner* — Jacob M Amick
*Assistant Examiner* — Charles Brauch
(74) *Attorney, Agent, or Firm* — Baker Hughes Patent Org.

(57) ABSTRACT

A dry gas extraction device is described, for extracting a dry gas from a wet gas flow. The device comprises a wet gas duct having a side wall surrounding an inner gas flow volume. The device further comprises at least one dry gas intake port located in a position inside the gas flow volume at a distance from the side wall.

9 Claims, 5 Drawing Sheets

(51) Int. Cl.

| | |
|---|---|
| ***F04D 29/10*** | (2006.01) |
| ***F04D 17/12*** | (2006.01) |
| ***F04D 29/08*** | (2006.01) |
| ***F04D 29/28*** | (2006.01) |
| ***F04D 29/42*** | (2006.01) |

(52) U.S. Cl.
CPC ..... *F04D 29/104* (2013.01); *F04D 29/124* (2013.01); *F04D 29/286* (2013.01); *F04D 29/4206* (2013.01)

(56) References Cited

U.S. PATENT DOCUMENTS

| | | | |
|---|---|---|---|
| 6,273,674 | B1 | 8/2001 | Charron |
| 2010/0135769 | A1 | 6/2010 | Kleynhans |
| 2012/0230812 | A1 | 9/2012 | Jonen |

FOREIGN PATENT DOCUMENTS

| | | | |
|---|---|---|---|
| FR | 2 574 871 | B1 | 4/1989 |
| RU | 2 133 880 | C1 | 7/1999 |
| SU | 211006 | A1 | 2/1968 |
| WO | 2011061142 | A | 5/2011 |

OTHER PUBLICATIONS

International Search Report and Written Opinion issued in connection with corresponding PCT application PCT/EP2015/061422 dated Aug. 13, 2015.
Machine translation and First Office Action and Search issued in connection with corresponding CN Application No. 201580027781.6 dated Jun. 5, 2018.
Office Action and Search issued in connection with corresponding RU Application No. 2016143915 dated Nov. 14, 2018.

* cited by examiner

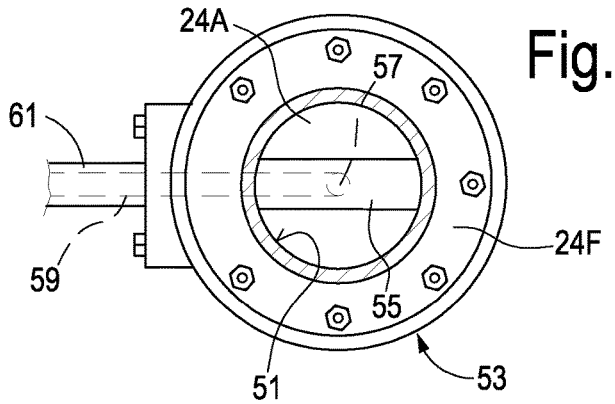
Fig.5
Fig.3
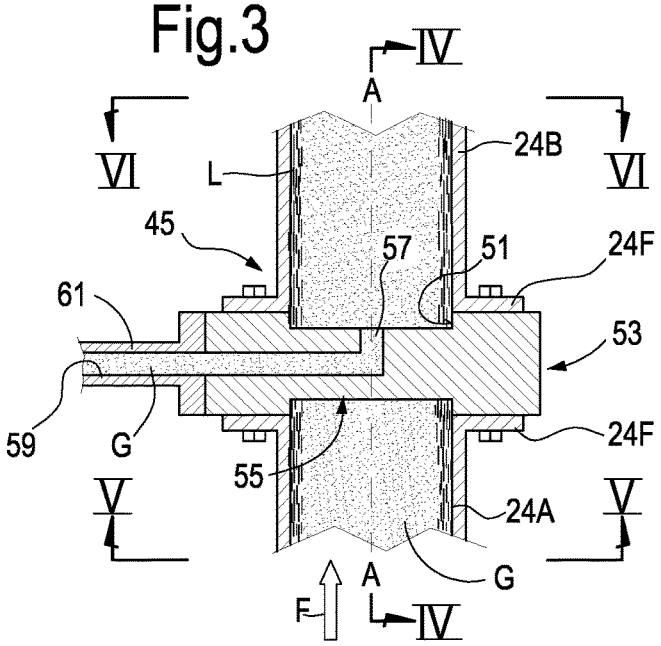
Fig.4
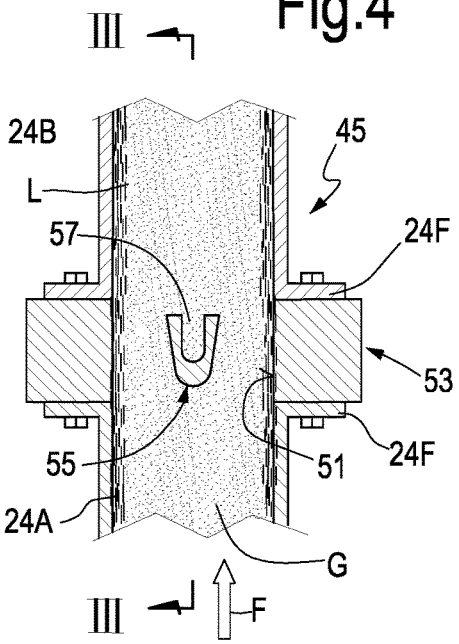
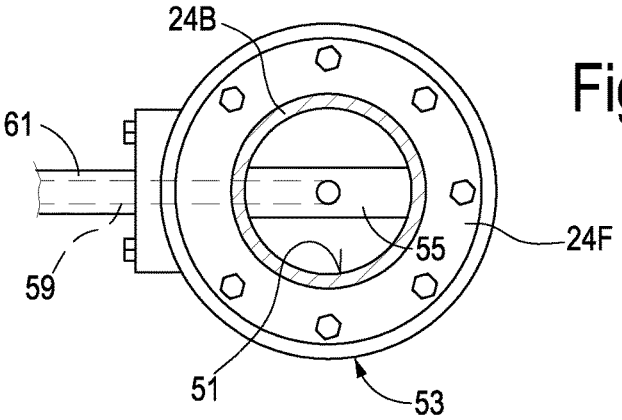
Fig.6

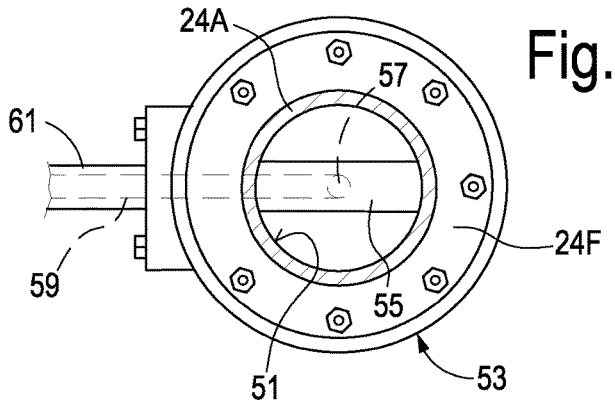
Fig.9
Fig.7
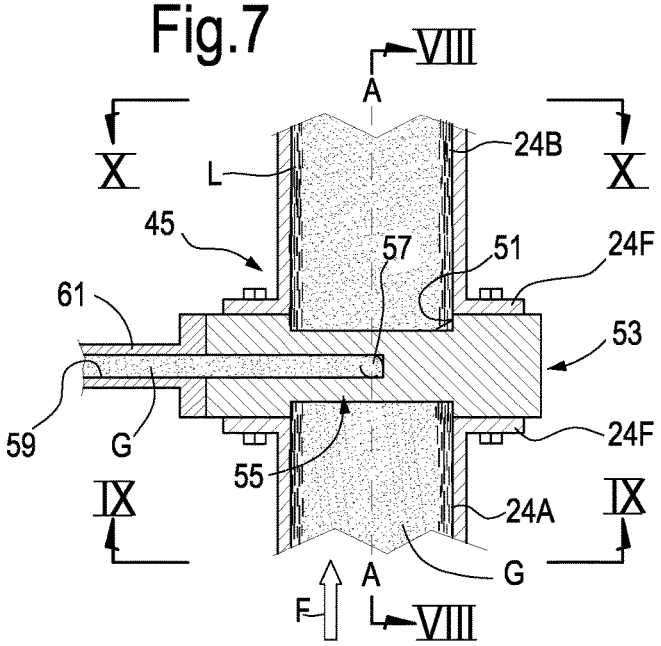
Fig.8
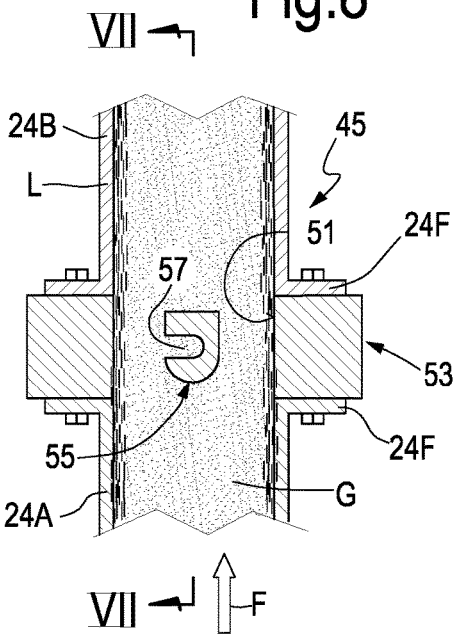
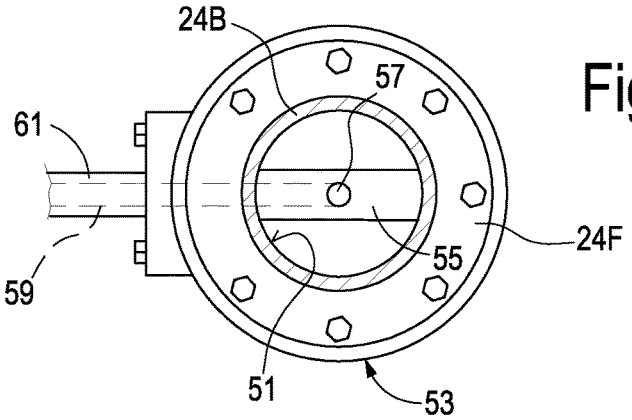
Fig.10

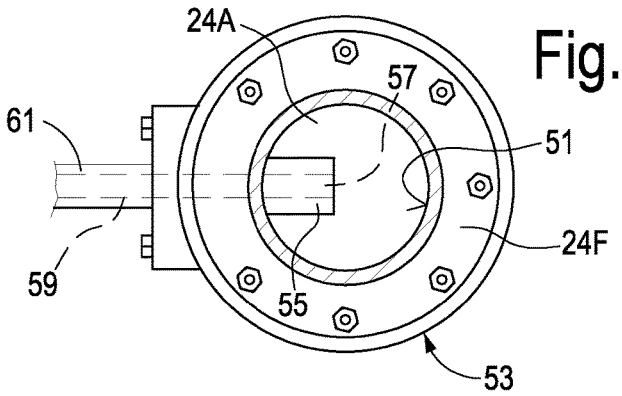
Fig.13
Fig.11
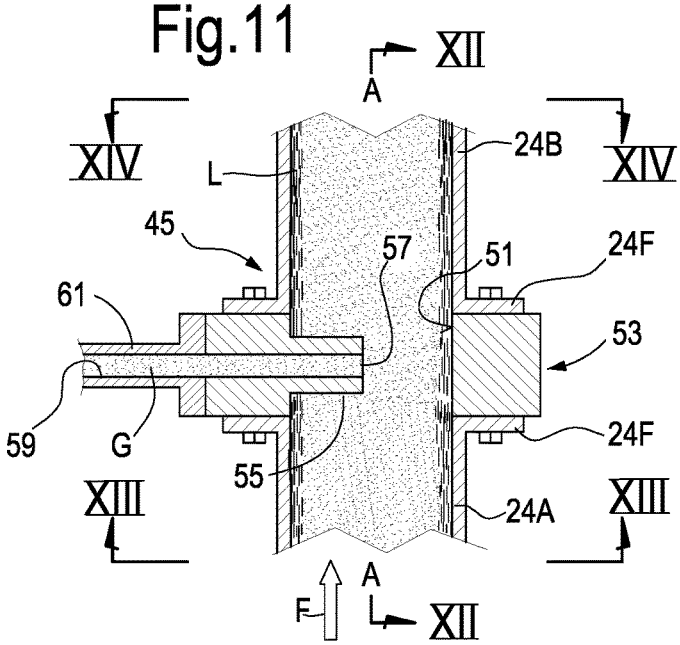
Fig.12
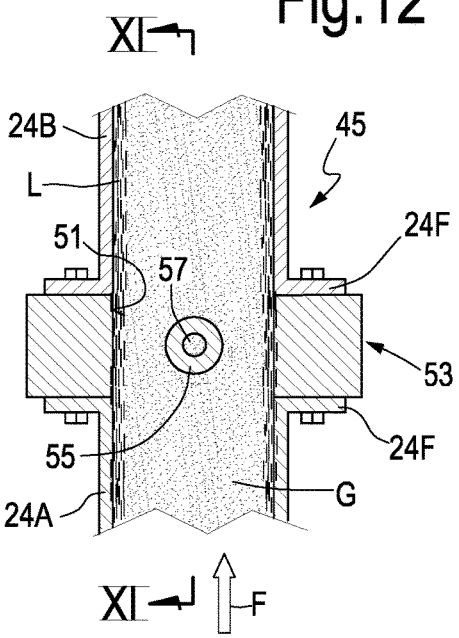
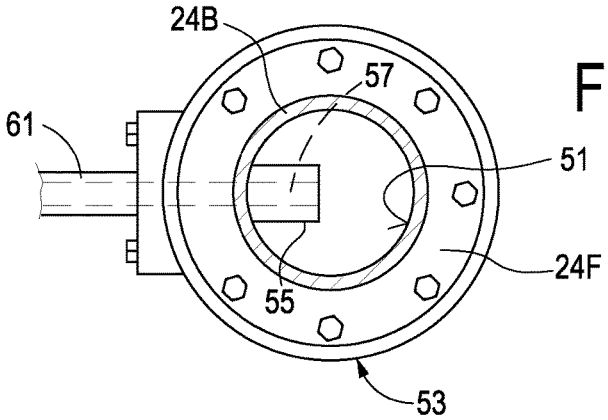
Fig.14

DRY GAS EXTRACTION DEVICE AND METHOD

BACKGROUND

The present disclosure relates generally to compressors and more specifically to improvements relating to wet gas compressors.

A compressor is a machine which accelerates particles of a compressible fluid, e.g. a gas, through the use of mechanical energy to, ultimately, increase the pressure of that compressible fluid. Compressors are used in a number of different applications, including processing of hydrocarbon gas, and more specifically so-called wet gas. A wet gas, as commonly understood in the art, is a gas containing a percentage of liquid matter, usually in the form of small droplets which are dragged along with the main gas flow through the compressor. Wet gas is commonly present in oil and gas applications, e.g. in submarine systems for the extraction of hydrocarbons.

So-called centrifugal compressors, in which the gas is accelerated by means of rotating impellers provided with blades defining gas flow channels, are widely used for processing wet gas, specifically hydrocarbons, in oil and gas applications.

Centrifugal compressors can be fitted with a single impeller, i.e., a single stage configuration, or with a plurality of impellers in series, in which case they are frequently referred to as multistage compressors. Each centrifugal compressor stage typically includes a casing, a gas inlet arranged at a compressor suction side and where through gas to be compressed is fed to the compressor, and one or more impellers mounted on a shaft and arranged for rotation in the casing. The impellers accelerate the gas particles providing kinetic energy thereto. The accelerated gas delivered by the impeller flows through a respective diffuser, which converts kinetic energy of the gas delivered by the respective impeller into pressure energy. Finally, the compressed gas delivered exiting the last diffuser is collected, e.g. in a volute, and delivered through a gas outlet, arranged at the compressor delivery side.

Various types of gases are processed by centrifugal compressors, some of which are toxic or have a potentially negative environmental impact. Accordingly, centrifugal compressors are provided with sealing systems, usually arranged at or near opposite ends of the shaft that supports the impeller(s). Sealing systems prevent gas leakages from the compressor casing. Single rotor centrifugal compressors are usually provided with two separate seals as part of this sealing system, i.e. one for each end of the shaft, while in an overhung centrifugal compressor it is usually sufficient to seal the shaft end, located immediately downstream of the impeller.

Recently, so-called "dry gas seals" are becoming more and more popular to provide efficient sealing of centrifugal compressors. Dry gas seals can be described as non-contacting, dry-running mechanical face seals, which include a mating or rotating ring and a primary or stationary ring. In operation, grooves in the rotating ring generate a fluid-dynamic force causing the stationary ring to separate and create a gap between the two rings. These seals are referred to as "dry" since they do not require lubricating oil which, among other things, greatly reduces their maintenance requirements. A dry gas seal must be fed with a constant small flow of dry gas, so that the above mentioned fluid-dynamic effect is maintained during operation of the compressor.

An exemplary embodiment of a dry gas seal for centrifugal compressors is disclosed in WO-A-2011061142, which is entirely incorporated herein by reference. Further details on dry gas seals can be found in the above mentioned publication and other patent literature cited therein.

Dry gas for the operation of the dry gas seals in a compressor is usually provided by taking a small fraction of the gas processed by the compressor and delivering it towards the dry gas seal. When dry gas seals are used in so-called wet gas compressors, liquid particles shall be removed from the gas which is diverted towards the dry gas seal systems, since liquid contaminants can damage the dry gas seals and anyhow negatively affect their operation. Gas diverted from the main gas flow in the compressor is thus processed in a so-called dry gas skid, to remove contaminants and impurities therefrom, before delivering the gas to the dry gas seals.

Efficiency of the dry gas skids would be improved if the amount of contaminants in the inlet gas flow were minimized. There is therefore a need for an improved system of gas extraction from the gas stream processed in wet gas compressors.

BRIEF DESCRIPTION

A dry gas extraction device is provided, for extracting a dry gas from a wet gas flow. According to exemplary embodiments, the device comprises a wet gas duct having a side wall surrounding an inner gas flow volume. At least one dry gas intake port is located in a position inside the gas flow volume at a distance from the side wall. A projection extends inwardly from the side wall, so that at least one dry gas intake port is arranged on the projection. The cross section of the projection is shaped for optimizing the flow condition around the projection.

In the context of the present description and attached claims, the term "dry gas" shall be understood as designating a gas which has a smaller wet content than the main wet gas flow processed by a turbomachine, e.g. a centrifugal compressor, whereto the device is combined.

Locating the dry gas intake port in a position spaced apart from the side wall of the duct, through which the wet gas flows, the gas extracted through the dry gas intake port has a reduced amount of liquid, such that a more efficient treatment of the gas is made possible, and the operation of dry gas seals or any other auxiliary component, device or facility of the turbomachine using the extracted dry gas is improved.

In order to further reduce the amount of liquid contained in the extracted dry gas, according to some embodiments, the dry gas intake port has an inlet oriented in counter-flow direction with respect a wet gas flow. A counter-flow direction as understood herein is a direction such that the speed vector of the dry gas flowing into the dry gas intake port has a component parallel to the speed vector of the wet gas flow, which is either zero or oriented opposite the speed vector of the wet gas flow.

According to some exemplary embodiments, the dry gas extraction device comprises a projection or crosspiece extending inwardly from the side wall towards the inner gas flow volume. The at least one dry gas intake port is arranged on the projection. The projection or crosspiece can extend across the entire width of the inner gas flow volume, i.e. can bridge across the wet gas duct and can be connected to the side wall surrounding the gas flow volume at both ends thereof. In other embodiments, the projection or crosspiece can extend cantileverly from the side wall, i.e. can overhang therefrom and have a free distal end at a distance from the side wall. In some embodiments the free distal end of the projection can be arranged at or near the center or around the center of the gas flow volume or in a position substantially lying on the axis of wet gas duct.

According to a further aspect, disclosed herein is a system comprising: a wet gas compressor; at least one sealing device arranged between a rotary member and a stationary member of the wet gas compressor; a wet gas line; a dry gas extraction device as described above; and a dry gas flow path fluidly connecting the dry gas intake port of the dry gas extraction device with the sealing device. The sealing device can be a dry gas seal. Connection between the dry gas extraction device and the sealing device can be a direct connection. In other embodiments, the connection is through a dry gas treatment skid, where the dry gas extracted via the dry gas extraction device is further treated, e.g. filtered or otherwise treated to remove residues of liquid or solid contaminants.

According to a yet further embodiment, the disclosure relates to a method for extracting a dry gas from a wet gas flow flowing in a wet gas duct, the method comprising the steps of: arranging at least one dry gas intake port located in a position inside the wet gas duct, at a distance from a wall of the wet gas duct; and removing, through the dry gas intake port, a dry gas flow from the wet gas duct.

According to some embodiments, the method can further comprise the step of arranging the at least one dry gas intake port in a counter-flow orientation with respect to the wet gas flow.

According to a further aspect, the subject matter disclosed herein concerns a method for operating a dry gas sealing arrangement in a wet gas compressor, comprising the steps of: arranging at least one dry gas intake port located in a position inside a wet gas duct, at a distance from a wall of the wet gas delivery duct; removing, through the dry gas intake port, a dry gas flow from the wet gas duct; and providing the dry gas flow to the dry gas sealing arrangement.

Features and embodiments are disclosed here below and are further set forth in the appended claims, which form an integral part of the present description. The above brief description sets forth features of the various embodiments of the present invention in order that the detailed description that follows may be better understood and in order that the present contributions to the art may be better appreciated. There are, of course, other features of the invention that will be described hereinafter and which will be set forth in the appended claims. In this respect, before explaining several embodiments of the invention in details, it is understood that the various embodiments of the invention are not limited in their application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which the disclosure is based, may readily be utilized as a basis for designing other structures, methods, and/or systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein:

FIG. 3 illustrates a first embodiment of a device according to the present disclosure in a sectional view according to line of FIG. 4;

FIG. 4 illustrates a sectional view according to line IV-IV of FIG. 3;

FIG. 5 illustrates a cross-sectional view according to line V-V of FIG. 3;

FIG. 6 illustrates a cross-sectional view according to line VI-VI of FIG. 3;

FIG. 7 illustrates a sectional view according to line VII-VII of FIG. 8 of a further embodiment of the subject matter disclosed herein;

FIG. 8 illustrates a sectional view according to line VIII-VIII of FIG. 7;

FIGS. 9 and 10 illustrate cross-sectional views according to lines IX-IX and X-X of FIG. 7;

FIG. 11 illustrates a sectional view according to line XI-XI of FIG. 12 of a further embodiment of the subject matter disclosed herein;

FIG. 12 illustrates a sectional view according to line XII-XII of FIG. 11;

FIGS. 13 and 14 illustrate cross-sectional views according to lines XIII-XIII and XIV-XIV of FIG. 11.

DETAILED DESCRIPTION

The following detailed description of the exemplary embodiments refers to the accompanying drawings. The same reference numbers in different drawings identify the same or similar elements. Additionally, the drawings are not necessarily drawn to scale. Also, the following detailed description does not limit the invention. Instead, the scope of the invention is defined by the appended claims.

Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

Figure 1:
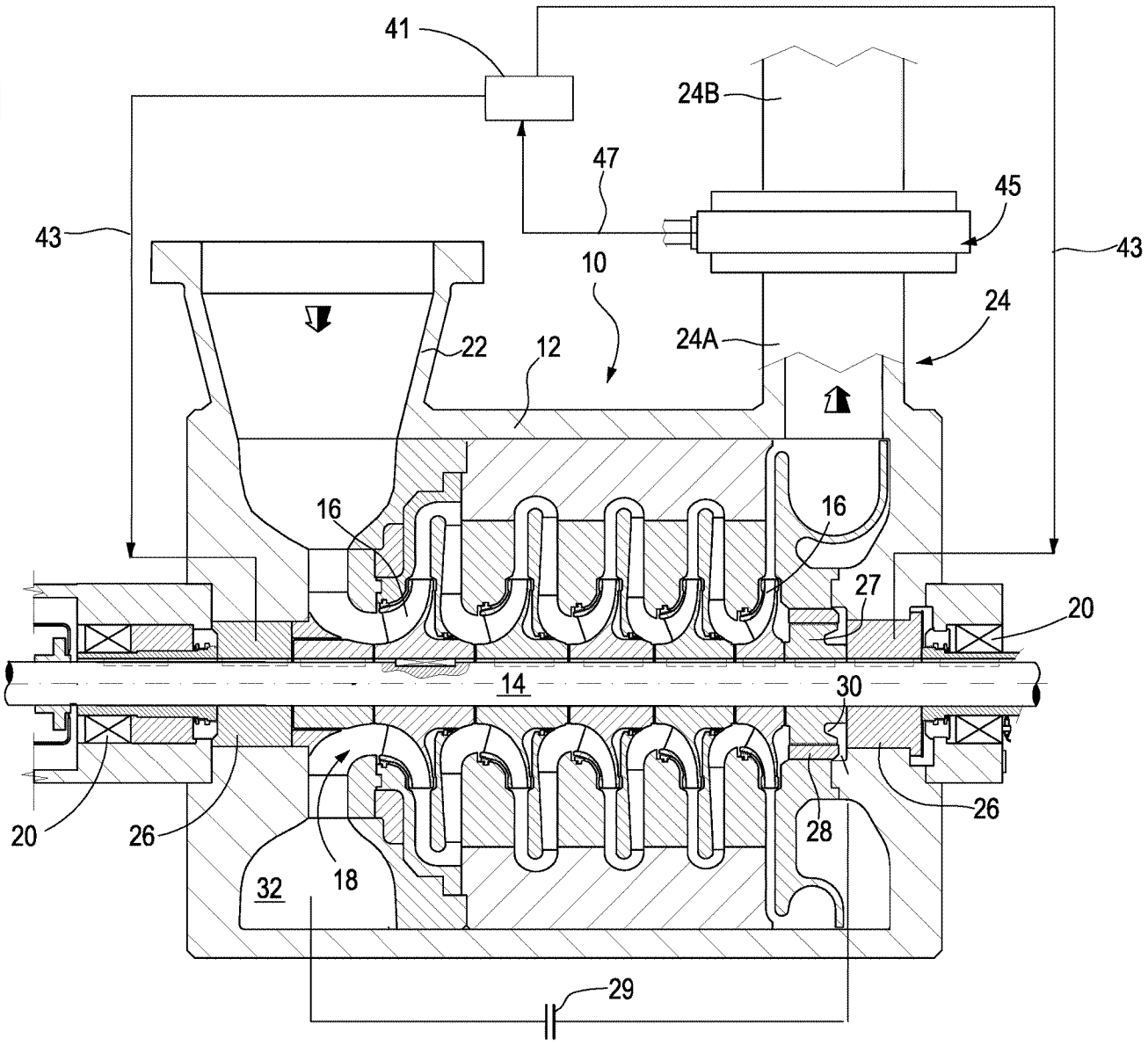
FIG. 1 illustrates a sectional view of a multistage centrifugal compressor, wherein the subject matter disclosed herein can be embodied.

To provide some context for the subsequent description of dry gas extraction systems according to the subject matter disclosed herein, FIG. 1 schematically illustrates a multistage centrifugal compressor 10, wherein dry gas sealing systems may be employed. According to the schematic of FIG. 1, the compressor 10 comprises a casing 12 rotatingly housing a compressor shaft 14. A plurality of centrifugal impellers 16 are mounted on the compressor shaft 14 and form therewith a compressor rotor 18. For the sake of simplicity, in FIG. 1 five impellers 16 are shown. The number of impeller and stages of the compressor is by way of example only. It shall be understood that a different number of impeller and compressor stages, e.g. one, two, three, four, six or more impellers can be provided. Bearings 20 arranged at both ends of the compressor shaft 14 radially and axially support the compressor rotor 18.

The compressor 10 further comprises a gas inlet, schematically shown at 22 at the suction side thereof, and a gas outlet, schematically shown at 24 at the delivery side thereof. Gas at a suction pressure is ingested by the compressor through gas inlet 22 and is delivered through gas outlet 24 at a delivery pressure higher than the suction pressure.

Sealing systems 26 are provided to reduce or prevent gas leakages from the interior of the casing, where the impellers are arranged, towards the bearings 20 and therefrom into the environment. One or both sealing systems 26 can be comprised of one or more dry gas seals, not shown in detail. The dry gas seals can be configured e.g. as disclosed in WO-A-2011/061142.

The compressor 10 further comprises a balance drum 27, which compensates for the axial thrust generated by the impellers 16 when processing the gas. A balance-drum labyrinth seal 28 is provided around the balance drum. A balance line 29 connects a chamber 30 located adjacent the balance drum 27, opposite the impellers 16, to the inlet of the first compressor stage, such that the pressure in chamber 30, i.e. on the outboard side of the balance drum 27, is maintained at the same level as the pressure at which the process gas enters via duct 22.

Further referring to FIG. 1, reference number 41 schematically illustrates a dry gas treatment skid, which is connected via lines 43 to the dry gas seals provided in the sealing systems 26. The dry gas treatment skid 41 can be fed with gas taken from a suitable location in or around the compressor 10. According to some embodiments, gas is extracted at or downstream the last compressor stage. This may be beneficial since a high pressure and hot gas is made available for the dry gas seals.

According to exemplary embodiments, the gas is extracted by means of a dry gas extraction device 45, which can be arranged at the gas outlet duct 24 or downstream thereof. In FIG. 1 the dry gas extraction device 45 is schematically shown at the delivery flange of the compressor 10. A gas delivery line 47 connects the dry gas extraction device 45 to the dry gas treatment skid 41.

Figure 2:
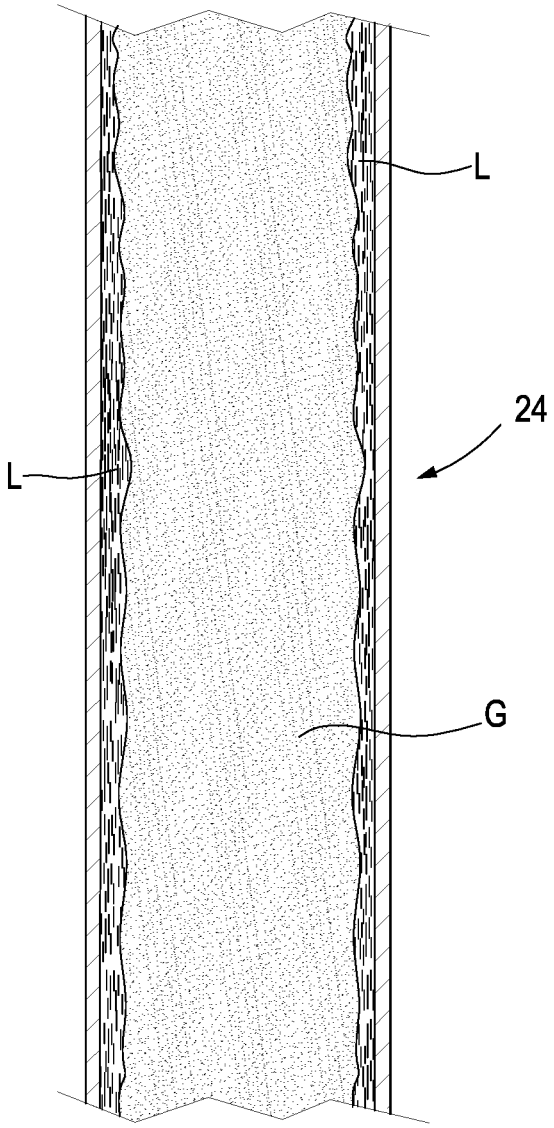
FIG. 2 illustrates a sectional view of a wet-gas flow in a duct.

When the gas processed by the compressor 10 contains a fraction of liquid, the fluid flow in the ducts, and specifically in the gas outlet duct 24, will be an annular flow as schematically shown in FIG. 2. The gaseous fraction G of the flow will concentrate in the central part of the gas outlet duct 24, while the liquid fraction L will concentrate along the peripheral area of the duct 24, namely adjacent the inner surface of the wall of the gas outlet duct 24. As suggested herein, gas is extracted from the gas flow at a distance from the side wall of the duct 24, so that a smaller amount of liquid contaminants will be dragged along with the flow of extracted gas. For this purpose, one or more dry gas intake ports are arranged in the interior of the gas outlet duct 24 or in any other wet gas duct. Gas is thus extracted from the main flow in the wet gas duct in a position where the liquid fraction is lower than along the walls of the wet gas duct.

A first exemplary embodiment of a dry gas extraction device according to the present disclosure is shown in FIGS. 3 to 6. According to this embodiment, the dry gas extraction device 45 comprises a wet gas duct 51, which can be formed in a flange 53. The flange 53 forms a side wall which surrounds an inner gas flow volume, through which the wet gas flows. The inner gas flow volume can have a circular cross section, as depicted in FIGS. 3 and 4. Other cross sectional shapes are however possible. The wet gas duct 51 can be arranged between two sequentially arranged portions of gas delivery duct or gas outlet duct 24. In the exemplary embodiment of FIGS. 3 to 6, 24A and 24B designate two portions of the gas outlet duct 24. The duct 24 can be in general any portion of the gas line through which the compressed gas is delivered from the compressor 10 towards a following component of the gas processing line, not shown. 24F schematically indicates two flanges of the gas outlet duct portions 24A, 24B, between which the flange 53 of the dry gas extraction device 45 is mounted.

According to some embodiments, a projection 55 extends from the flange 53 towards the interior of the wet gas duct 51. The projection 55 can be in the form of a crosspiece. The projection 55 can project in a generally radial direction from the inner surface of flange 53. In some embodiments, as shown in FIGS. 3-6, the crosspiece or projection 55 extends for the full inner diameter of the wet gas duct 51, such that the crosspiece 55 is connected at both opposing ends thereof to the flange 53. In other embodiments, the crosspiece 55 can be shorter than the inner diameter of the flange 53 and extend in an overhanging fashion inside the inner volume of the wet gas duct 51.

In the embodiment illustrated in FIGS. 3 to 6 a dry gas intake port 57 is provided in an intermediate location along the radial extension of the projection 55. According to the exemplary embodiment illustrated in the drawings, the dry gas intake port 57 is arranged approximately at or near the center axis A-A of the flange 53. In other embodiments the dry gas intake port can be located nearer to the side wall of the gas duct 51. The crosspiece or projection 55 can be then shorter than shown in the attached exemplary drawings. Important is that the dry gas intake port 57 be located at a distance from the inner surface of the wet gas duct 51. In an embodiment, the dry gas intake port 57 can be oriented in a counter-flow fashion, i.e. the dry gas intake port 57 is located on the projection 55 so as to face in a direction opposite the direction of flow of the gas through the gas outlet duct 24. The direction of the main gas flow in the gas outlet duct 24 is represented by arrow F in FIGS. 3 and 4.

As shown in FIG. 4, the projection or crosspiece 55 can have a cross section which is shaped so as to have optimal flow conditions around the crosspiece 55 in the area where the dry gas intake port 57 is located. According to some embodiments, the projection 55 can have a leading side or leading edge, facing upstream with respect to the direction of flow F, and a trailing side or trailing edge facing downstream. In the embodiment shown in FIGS. 3 to 6 the dry gas intake port 57 is located at the trailing side of the projection 55. The leading side, or leading edge, of the projection 55 as well as the remaining surface thereof can be configured so as to reduce friction losses. Additionally, in an embodiment, the cross section of the projection 55 can be configured so as to prevent or reduce the formation of swirls behind the projection 55, i.e. in front of the dry gas intake port 57.

The dry gas intake port 57 is in fluid communication with the gas delivery line 47 through a gas passage 59 extending from the dry gas intake port 57 towards a connector 61 provided at the periphery of flange 53.

The position and the orientation of the dry gas intake port 57 are such that gas entering the dry gas intake port 57 has a wet content, i.e. a percentage of liquid phase, which is substantially lower than the mean liquid content in the wet gas flowing through the wet gas duct 51. A reduced amount of liquid thus enters the dry gas treatment skid 41.

The compressor 10 and the dry gas extraction device 45 operate as follows. Wet gas is sucked by compressor 10 at the gas inlet 22, compressed and delivered through gas outlet 24. A small portion of gas is extracted through the dry gas extraction device 45 and delivered to the dry gas treatment skid 41. Treated dry gas is delivered via lines 43 to the dry gas seals in sealing arrangements 46. As most of the wet content is removed from the extracted gas thanks to the position of the dry gas intake port 57, only a small amount of residual liquid phase needs to be removed from the gas in the dry gas treatment skid 41.

FIGS. 7 to 10 illustrate a further exemplary embodiment of a dry gas extraction device 45 according to the present disclosure. The same reference numbers designate the same or similar components as shown in FIGS. 3-6. The embodiment of FIGS. 7-10 differs from the embodiment of FIGS. 3-6 in respect of the position of the dry gas intake port 57.

In the embodiment of FIGS. 7-10 the dry gas intake port 57 is located in a position intermediate the leading side and the trailing side of the projection 55. While in the previously described embodiment the dry gas intake port 57 is oriented such that the angle formed between the main gas flow direction (F) and the direction of the extracted gas through the dry gas intake port 57 is approximately 180°, in the embodiment of FIGS. 7-10 the dry gas flow through the dry gas intake port 57 is oriented at approximately 90° with respect to the main gas flow direction F. The orientation of the dry gas intake port 57 is in any case such as to reduce the ingress of liquid and possibly solid parts from the main gas flow into the dry gas intake port 57. The position of the dry gas intake port 57 in FIGS. 7-10 minimizes possible detrimental effects of swirls around the projection 55 on the dry gas intake flow.

In further exemplary embodiments, not shown, two opposite dry gas intake ports can be provided on the two side surfaces of the projection 55.

In some embodiments, the dry gas intake ports are located at about the center axis A-A of the wet gas duct 51, where the amount of liquid matter is smaller. In other embodiments, however, the dry gas intake port can be located in a position intermediate between the center axis of the wet gas duct 51 and the inner surface thereof.

FIGS. 11 to 14 illustrate a further exemplary embodiment of a dry gas extraction device 45 according to the present disclosure. The same reference numbers are used to designate the same or equivalent components as in FIGS. 3-10. In the exemplary embodiment of FIGS. 11-14 the projection or crosspiece 55 is shorter than the inner diameter of the wet gas duct 51. The projection or crosspiece 55 thus projects cantileverly into the hollow cross sectional volume of the wet gas duct 51. In some embodiments the crosspiece or projection 55 can extend into the inner volume of the wet gas duct 51 by approximately the radius thereof, so that the distal end of the projection or crosspiece 55 is located approximately at or near the center axis A-A of the wet gas duct 51. In some embodiments at least one dry gas intake port 57 is located at the distal end of the projection or crosspiece 55, at or around the center axis A-A, as shown in FIGS. 11 and 12 in particular.

In other embodiments, not shown, at least one intake port 57 can be arranged in a position intermediate the proximal end and the distal end of the projection 55, i.e. between the free end located in a central position in the wet gas duct 51 and the inner surface of the wet gas duct 51. In yet further embodiments (not shown) the projection or crosspiece 55 can extend beyond the center axis A-A, less than the diameter of the wet gas duct 51, and the dry gas intake port(s) 57 can be located on one or both sides of the crosspiece projection 55, around the center axis A-A of the wet gas duct 51.

Irrespective of the shape and dimension of the projection or crosspiece 55 and of the position and number of the dry gas intake ports 57, the latter are positioned at a distance from the inner surface of the wet gas duct 51, where the major part of the liquid (and possibly solid) matter contained in the gas flow concentrate. By positioning the dry gas intake ports in a position inside the cross section of the wet gas duct 51, less liquid and potentially solid matter is dragged along with the gas entering the dry gas intake port, and the dry gas treatment skid can operate more efficiently.

While the disclosed embodiments of the subject matter described herein have been shown in the drawings and fully described above with particularity and detail in connection with several exemplary embodiments, it will be apparent to those of ordinary skill in the art that many modifications, changes, and omissions are possible without materially departing from the novel teachings, the principles and concepts set forth herein, and advantages of the subject matter recited in the appended claims. Hence, the proper scope of the disclosed innovations should be determined only by the broadest interpretation of the appended claims so as to encompass all such modifications, changes, and omissions. In addition, the order or sequence of any process or method steps may be varied or re-sequenced according to alternative embodiments.

What is claimed is:

1. A dry gas extraction device for extracting a dry gas from a wet gas flow, the device comprising:

a wet gas duct having a side wall surrounding an inner gas flow volume;

at least one dry gas intake port located in a position inside the gas flow volume at a distance from the side wall; and a projection extending inwardly from the side wall, the at least one dry gas intake port arranged on the projection; and a flange surrounding the inner gas flow volume, the projection extending diametrically across the flange, wherein the cross section of the projection is shaped for optimizing a flow condition around the projection.

2. The device of claim 1, wherein the at least one dry gas intake port has an inlet oriented in counter-flow direction with respect a wet gas flow direction in the wet gas duct.

3. The device of claim 1, wherein the projection extends across the inner gas flow volume, the projection having a first end and a second end connected at opposite positions to the side wall.

4. The device of claim 1, wherein the projection has a leading side and a trailing side, the trailing side arranged downstream of the leading side with respect to the wet gas flowing direction in the wet gas duct.

5. The device of claim 4, wherein the at least one dry gas intake port is located on the projection at a distance from the leading side, between the leading side and the trailing side, or at the trailing side.

6. The device of claim 1, wherein the at least one dry gas intake port is arranged in a position substantially lying on the axis of the wet gas duct.

7. The device of claim 1 arranged in a wet gas line of a system, the system comprising:

a wet gas compressor;

at least one sealing device arranged between a rotary member and a stationary member of the wet gas compressor; and a dry gas flow path fluidly connecting the at least one dry gas intake port to the at least one sealing device.

8. The system device of claim 7, wherein the wet gas line of the system is arranged to receive compressed gas at a delivery side of the wet gas compressor.

9. The device of claim 7, wherein the at least one sealing device of the system comprises a dry gas seal.

* * * * *